United States Patent [19]

Duering

[11] 4,437,587

[45] Mar. 20, 1984

[54] SQUEEZE BOTTLE FOR PRODUCING AN ARBITRARILY DIRECTED LIQUID STREAM

[75] Inventor: Walter Duering, Zurich, Switzerland

[73] Assignee: Duering AG, Daellikon, Switzerland

[21] Appl. No.: 275,963

[22] Filed: Jun. 22, 1981

[30] Foreign Application Priority Data

Jul. 3, 1980 [CH] Switzerland ..... 5117/80

[51] Int. Cl.[3] ..... B65D 37/00

[52] U.S. Cl. ..... 222/207; 222/211; 222/456

[58] Field of Search ..... 222/207, 211, 215, 464, 222/454, 456, 457, 460; 239/327

[56] References Cited

U.S. PATENT DOCUMENTS

| | | | |
|---|---|---|---|
| 236,997 | 1/1881 | Dodge | 222/456 |
| 570,759 | 11/1896 | Law | 222/456 |
| 836,466 | 11/1906 | Sears | 222/456 |
| 2,212,367 | 8/1940 | Halsey | 222/460 X |
| 2,728,491 | 12/1955 | Aneshansley | 222/211 X |
| 2,738,107 | 3/1956 | Graham | 222/215 |
| 2,987,261 | 6/1961 | McCuiston et al. | 239/327 X |
| 3,100,068 | 8/1963 | Kersten | 222/211 X |
| 3,141,574 | 7/1964 | Donoghue | 222/207 X |

FOREIGN PATENT DOCUMENTS

| | | | |
|---|---|---|---|
| 440548 | 12/1967 | Switzerland | 222/207 |

*Primary Examiner*—Joseph J. Rolla
*Assistant Examiner*—Kevin P. Shaver
*Attorney, Agent, or Firm*—W. G. Fasse; D. H. Kane, Jr.

[57] ABSTRACT

A squeeze bottle is internally provided with a partition wall (2) forming an overflow edge (3) for producing a liquid stream which may be directed arbitrarily in any desired direction, especially for cleaning toilet bowls. A bottle mouth (5) is connected to the smaller chamber (4) separated by the partition wall (2). An immersion pipe (17) projects to the bottom of the chamber (4) and determines the direction of spray. This direction assumes an angle of about 40° to the longitudinal central axis (7) of the bottle (1). By tilting the bottle, the chamber (4) may be refilled with the liquid present in the main part of the bottle (1).

11 Claims, 9 Drawing Figures

SQUEEZE BOTTLE FOR PRODUCING AN ARBITRARILY DIRECTED LIQUID STREAM

CROSS REFERENCE TO RELATED APPLICATION

The present invention relates to corresponding Swiss Patent Application 5117/80-7, filed in Switzerland on July 3, 1980. The priority of the Swiss patent application is hereby claimed.

BACKGROUND OF THE INVENTION

The invention relates to a squeeze bottle, especially a hand squeeze bottle, with a pour-out member or nozzle, especially for the cleansing of toilet bowls.

Typical prior art bottles, provided with a pour-out member or nozzle, from which a volume of liquid is squeezed out by hand in a squeezing motion, are, practically speaking, only suited for producing a downwardly directed stream. With the exception of brimful bottles, the content of the bottle cannot be sprayed upwardly if the bottle is inclined in an upward direction.

It is true that known bottles are provided with an immersion tube reaching into the inside of the bottle for producing an upwardly directed stream by hand induced pressure. However, such structure allows for only an upward spray. When cleaning, especially toilet bowls, it is desired to cleanse the inside of the upper flushing rim with an upwardly directed stream as well as cleansing the remaining areas of the bowl with a downwardly directed stream.

OBJECTS OF THE INVENTION

In view of the above it is the aim of the invention to achieve the following objects singly or in combination:

to construct a squeeze bottle, especially a hand squeeze bottle, so that a liquid stream may be produced while the bottle is in any position suitable for toilet bowl cleaning and in any partially filled state;

to shape a squeeze bottle so that it may be expediently manufacturable by the usual bottle blowing procedures using synthetic tubing for mass production purposes; and to provide a squeeze bottle which permits directing a stream or spray of the bottle content in substantially any desired direction by holding the bottle in a position suitable for effectively cleaning a toilet bowl without any separate squeeze-out mechanism.

SUMMARY OF THE INVENTION

According to the invention there is provided a squeeze bottle, especially a hand squeeze bottle, with a pour-out nozzle, especially for the cleaning of toilet bowls, which comprises a transversely extending partition wall or separation means forming an overflow edge inside the bottle, whereby said partition wall divides the interior of the bottle into a main portion or first chamber and a second chamber which is smaller relative to the main portion. A bottle mouth or discharge means projects from the bottle on the side opposite the overflow edge, said bottle mouth having an axis forming an acute angle with a longitudinal bottle axis such that a directed stream of fluid from the second smaller chamber may be produced by squeezing the bottle.

By means of this construction, it is possible to spray a liquid stream from the supply retained in the smaller chamber in any desired direction, independently of the volume remaining available in the larger chamber of the bottle as long as there is liquid in the smaller chamber. Since the bottle takes up only a small height in its horizontal position, the stream hits spots which are unaccessible to bottles held in an upright position. Furthermore, it is possible to produce the bottle in common bottle manufacturing machines once the blow mold has been adapted, whereby the greater difficulties and additional working steps caused by sharply angled nozzles are avoided.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
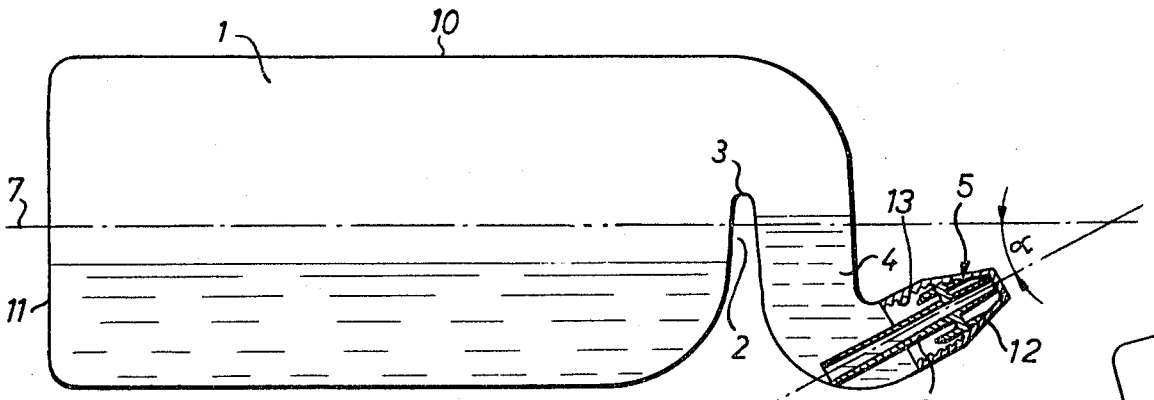
FIG. 1 shows a section through a squeeze bottle in a horizontal position with a spray direction slanting upwardly.
Figure 2:
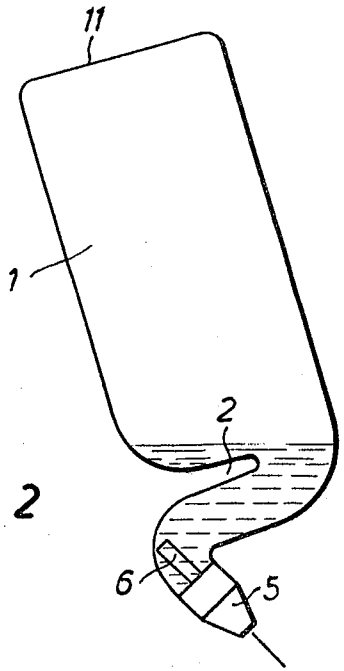
FIG. 2 is a schematic illustration of the bottle with a downwardly slanting spray stream direction.
Figure 3:
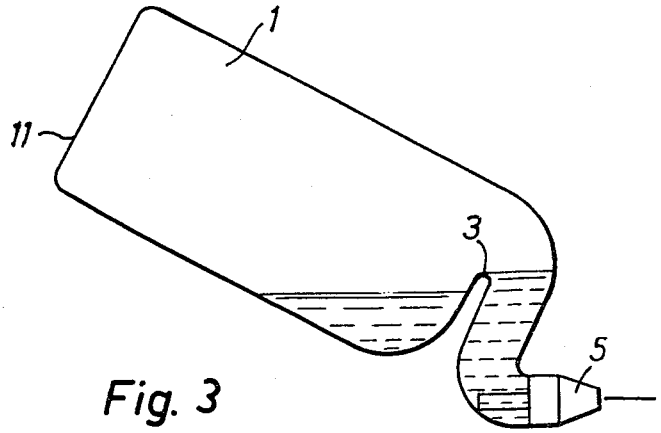
FIG. 3 shows a schematic illustration of the bottle for a horizontal spray direction.
Figure 4:
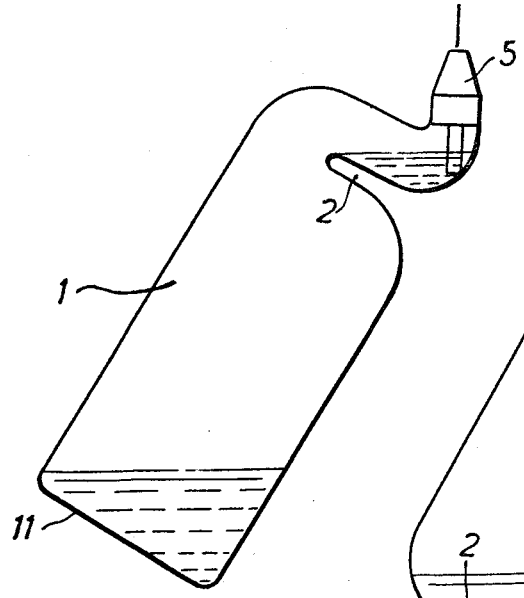
FIG. 4 is a schematic illustration of the bottle for a vertically upwardly directed spray direction.
Figure 5:
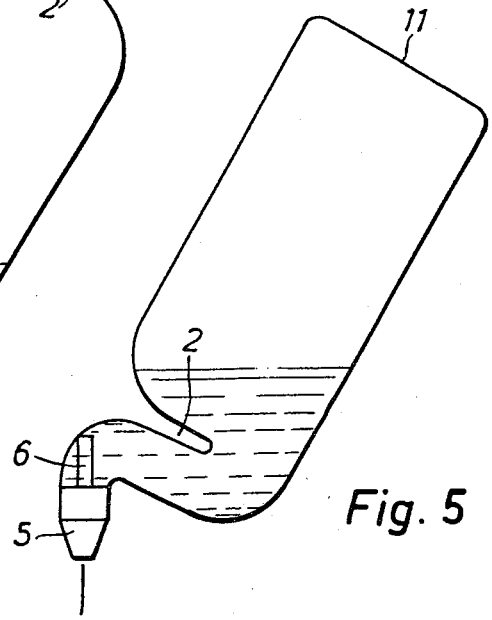
FIG. 5 is a schematic illustration of the bottle for a vertically downwardly directed spray direction.
Figure 9:
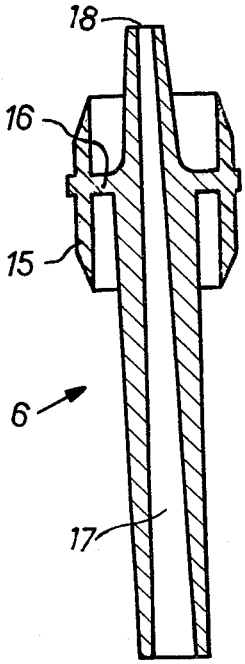
FIG. 9 is a section through the immersion pipe.

The squeeze bottle according to FIGS. 1 to 6 is made of an elastic synthetic material and may be compressed somewhat by hand so that a pressure in excess of the ambient pressure is established within the bottle enabling the liquid contained inside the bottle to be sprayed out of a pour-out or squeeze-out nozzle 6 in a bottle mouth 5. The inside of the bottle is divided into a main body 1 and a comparatively smaller chamber 4 by a partition wall 2 extending substantially perpendicularly to the bottle's longitudinal axis 7. The partition wall 2 is formed by a preferably wedge-shaped, double-walled restriction in the bottle wall material. The wedge shaped restriction comprises an overflow edge 3 which extends past the bottle's longitudinal first axis 7 and preferably leaves free approximately $\frac{1}{4}$ of the bottle cross-section. The wedge shaped restriction has a central plane extending substantially perpendicularly to said longitudinal axis 7. The body 1 of the bottle and the chamber 4 remain in flow-through connection so that liquid filled into the bottle may flow freely between the two inner spaces depending on the inclination of the bottle. The pour-out or squeeze-out nozzle 6 in the bottle mouth 5 leads away from the lower part of the chamber 4 of a bottle when the bottle takes up a substantially horizontal position. As shown in FIG. 9, the pour-out or squeeze-out nozzle 6 includes an immersion pipe 17 located within the bottle mouth 5 and reaching all the way to the lowest part of the chamber 4 when the bottle is in a horizontal position. The inner or clearance cross-sectional diameter of the immersion pipe 17 diminishes toward the discharge end 18. The immersion pipe 17 is surrounded by a pipe piece 15 forming a bushing which is inserted into the bottle mouth 5. The pipe piece or bushing 15 is connected to the immersion pipe 17 by crosspieces or lands 16 as best seen in FIG. 9. Ribs or fins may be arranged in a circular manner instead of the pipe piece or bushing 15. When not in use, the bottle mouth 5 and with it the pour-our or squeeze-out nozzle 6 is sealed by a cap 12 placed onto the outer threading 13 of the bottle mouth 5. Each of the cap 12, the immersion pipe 17 and the pipe piece 15 is made of a single or integral piece of synthetic material. Preferably, the bushing 15 and the immersion pipe 17 together form an integral one piece component as shown in FIG. 9. The bottle mouth 5 and the straight immersion pipe 17 extend coaxially relative to a central second axis 8, whereby the immersion pipe 17 determines the direction of the sprayed stream. The central axis 8 of the bottle mouth 5 and the longitudinal central axis 7 of the bottle 1 cross each other outside of the bottle and may include an angle $\alpha$, which is smaller than 50° as shown in FIG. 1. This angle $\alpha$ is within the range of 25° to 45°, preferably about 40° for effectively cleaning under the rim of a toilet bowl. The central axix 8 coincides with the direction of spray. Hence, pressure applied to the squeeze bottle by the fingers induces a rising internal pressure causing the liquid located in the chamber 4, or at least a part of this liquid, to be sprayed out through the immersion pipe 17. Consequently, an upwardly directed stream results when the bottle is in a horizontal or in a slanted, upwardly directed position, which stream is suited, for example, for the cleansing of the upper inner rims of toilet bowls. If the stream should be directed more orthogonally upwards, the bottle may be held more upwardly, since some liquid remains in the chamber 4 even if the bottle is only partially filled. The volume of the liquid in the chamber 4 is usually sufficient for the desired cleaning procedure. Should one or more squeezes of the bottle use up the liquid in the chamber 4, it is sufficient to incline the bottle into the position shown in FIG. 2 to refill the chamber 4. As shown in FIG. 3, the stream may be directed horizontally. Furthermore, FIG. 4 shows that a vertically upwardly directed spray direction is possible. FIG. 5 shows that the bottle may also spray vertically downwardly.

Figure 6:
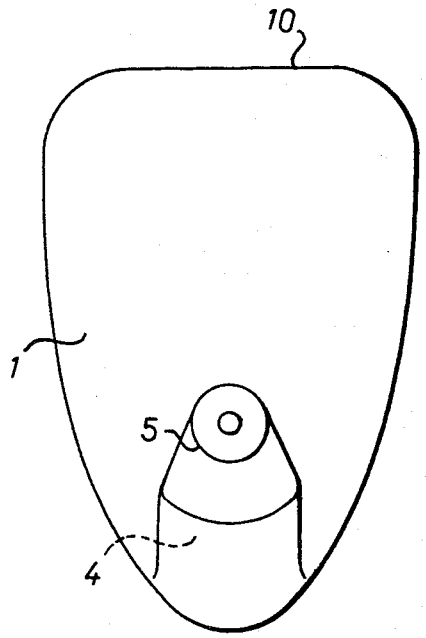
FIG. 6 is a front view of the squeeze bottle.
Figure 7:
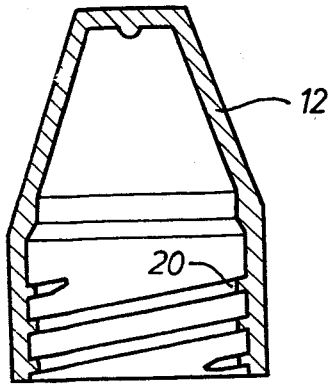
FIG. 7 is a section through the cap.
Figure 8:
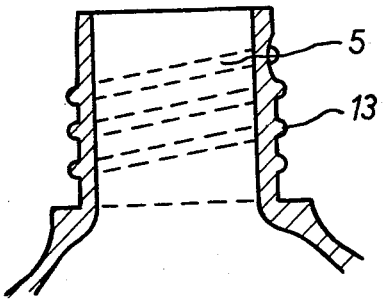
FIG. 8 is a section through the pour-out member or nozzle.

As shown in FIG. 6, the bottle's cross-section approximates part of an oval or vault, whereby the upper side 10 is flattened. The axis 8 and thus a spray out of the nozzle 6 intersects a plane defined by said flattened side 10. When not in use, the bottle is placed on its base 11 so that no fluid can flow out. Additionally, the flow-out or squeeze-out nozzle 6 is closed by the sealing cap 12 which has an inner threading 20 as shown in FIG. 7 cooperating with the outer threading 13 shown in FIG. 8.

The viscosity of the content may range from a watery to a cream-like consistency.

In addition to using this bottle for the cleansing of toilet bowls, the bottle may be used for any other purposes, especially when an upwardly directed stream is necessary, whereby the content of the bottle may consist of sprayable mediums other than cleaning liquids. The volume of the chamber 4 is approximately in the order of magnitude of 1/20 of the bottle volume.

Although the invention has been described with reference to specific example embodiments, it is to be appreciated, that it is intended to cover all modifications and equivalents within the scope of the appended claims.

What is claimed is:

1. A squeeze bottle, comprising a bottle body having bottle body wall means (1) made of a material sufficiently flexible for squeezing, said bottle body enclosing a bottle volume having a first longitudinal central axis (7), separation means (2) forming an overflow edge (3) in said bottle for separating said bottle volume into a first larger chamber and into a second smaller bottle neck chamber (4), bottle content discharge means having a second longitudinal central axis (8) and including a bottle mouth (5) forming part of said second bottle neck chamber (4), said bottle mouth (5) extending away from said second bottle neck chamber (4) opposite said separation means (2), said discharge means further including nozzle means (6) operatively mounted in said bottle mouth (5) for discharging a quantity of liquid from said squeeze bottle, said second longitudinal central axis (8) crossing said first longitudinal central axis on the side of said nozzle means (6) outside said bottle body (1) and enclose an acute angle ($\alpha$) smaller than 50°, whereby the bottle content may be squeezed out as a stream directed in substantially any desired direction, and wherein said separation means (2) forms a double walled restriction in said bottle body wall means, said restriction extending into said bottle body between said larger chamber and said smaller bottle neck chamber.

2. The squeeze bottle of claim 1, wherein said angle ($\alpha$) is within the range of 25° to 45°.

3. The squeeze bottle of claim 1, wherein said discharge means has an outer end with a tubular shape, said bottle further comprising separate immersion pipe means extending coaxially through said discharge means, and bushing means (15) operatively holding said separate immersion pipe means in said discharge means.

4. The squeeze bottle of claim 1, wherein said discharge means has a tubular portion with an outer threading thereon, said bottle further comprising cap means with an inner threading for cooperation with said outer threading.

5. The squeeze bottle of claim 1, wherein said separation means (2) is formed as a wedge shaped portion of the wall means forming said bottle body, said wedge shaped portion having a central plane extending substantially perpendicularly to said first longitudinal central axis (7).

6. The squeeze bottle of claim 1, wherein said separation means extends substantially transversely relative to said first longitudinal central axis (7) of said bottle body.

7. The squeeze bottle of claim 1, wherein said bottle body comprises a flat bottom on which the bottle stands upright when in a rest position, said bottle body further having a substantially vaulted cross-sectional shape which is curved along one side to form a vault and substantially flat along the opposite side for facilitating a squeezing of said squeeze bottle.

8. The squeeze bottle of claim 7, wherein said nozzle means (6) is directed along said second longitudinal central axis (8) which intersects a plane defined by said flat opposite side of said bottle body.

9. The squeeze bottle of claim 1, further comprising immersion pipe means (6) and bushing means (15) operatively holding said immersion pipe means inside said discharge means (5) in such position that said immersion pipe means (6) reaches with its inner end into said second smaller chamber (4).

10. The squeeze bottle of claim 9, wherein said smaller chamber has a bottom located adjacent said discharge means (5), said immersion pipe means having an inner end reaching substantially to said bottom.

11. The squeeze bottle of claim 10, wherein said immersion pipe means (6) has an outer end and an inner end and an inner diameter which diminishes from said inner end to said outer end, said holding means comprising said bushing means (15) being held in said discharge means and in turn holding said immersion pipe means (6), said immersion pipe means (6) and said bushing means (15) forming an integral single piece component.

* * * * *